US005370377A

United States Patent [19]

Van Der Meer

[11] Patent Number: 5,370,377

[45] Date of Patent: Dec. 6, 1994

[54] CLADDING PLANK INSTALLATION TOOL

[76] Inventor: Johannes Van Der Meer, Leisure Life Caravan Park, Wangi Road & Parkside Parade, Toronto, New South Wales 2283, Australia

[21] Appl. No.: 123,136

[22] Filed: Sep. 17, 1993

[30] Foreign Application Priority Data

Sep. 21, 1992 [AU] Australia ..... PL4852

[51] Int. Cl.[5] ..... B23Q 3/02

[52] U.S. Cl. ..... 269/43; 269/904; 33/647

[58] Field of Search ..... 33/646–649; 269/904, 37, 43, 289 R

[56] References Cited

U.S. PATENT DOCUMENTS

| | | | |
|---|---|---|---|
| 2,195,277 | 3/1940 | Kleinman | 269/296 |
| 2,401,054 | 5/1946 | Daley | 269/279 |
| 4,159,029 | 6/1979 | Matthews | 269/904 |
| 4,164,346 | 8/1979 | Sickler | 269/904 |
| 4,473,100 | 9/1984 | Wheeler | 33/647 |
| 4,484,392 | 11/1984 | DeFino et al. | 33/647 |

*Primary Examiner*—Robert C. Watson
*Attorney, Agent, or Firm*—Edwin D. Schindler

[57] ABSTRACT

A tool for use in the fixing of plank cladding where the tool includes a first member (1) and a second member (11) shorter than and spaced from the first member (1) to provide the sides of a plank receiving slot (36) which has a bottom (35), a hook (12) on the second member faces away from the first member (1), a plank retainer (21) extends through the first member (10) and is biassed by a spring (28) to obstruct the slot (36). In use the tool hook (12) is engaged with an already fixed support plank and the next plank to be fixed is supported on the retainer (21). When the next plank is part fixed the retainer (21) is withdrawn from the plank slot (36) to allow the part fixed plank to enter further into the slot (36) as the tool is raised to unhook it from the support plank.

4 Claims, 4 Drawing Sheets

CLADDING PLANK INSTALLATION TOOL

This invention relates to a tool which when used in multiples facilitates the installation by a single workman of long lengths of plank material commonly used as cladding for buildings.

Plank cladding material is able to flex and accordingly it has been common for at least two persons to be engaged in the support of a plank whilst fixing of the plank takes place. The cost of two workmen must thus be built into the cost of the cladding operation.

Another problem with the current methods of cladding plank fixing is the ability or willingness of the workmen to accurately fix the planks after the fixing of the first (lowermost) plank, which is usually very accurately fixed so as to act as a datum. The need to accomplish the cladding of a wall economically sometimes leads to the workmen adopting less than accurate practices in aligning the planks after the first. The present invention allows a single workman to very accurately position each plank relative to the plank previously fixed and further allows small accurate adjustments to the alignment of each plank relative to previously fixed planks before a plank is fixed. The economic advantage of using the tool of the invention is readily obvious.

Broadly stated, the invention provides a tool for use in the fixing of plank cladding where the tool includes a first elongated men, her, a second elongated member shorter than the first member and spaced from the first member, said members providing two sides of a plank receiving slot which has a bottom, a hook on the second member facing away from the first member, a retractable plank retainer extending through the first member and projecting at least part way across said slot at a location between the hook on the second member and the bottom of the slot and spaced from the bottom of the slot by a distance greater than the distance the tool needs to be moved to unhook said second member.

Figure 1:
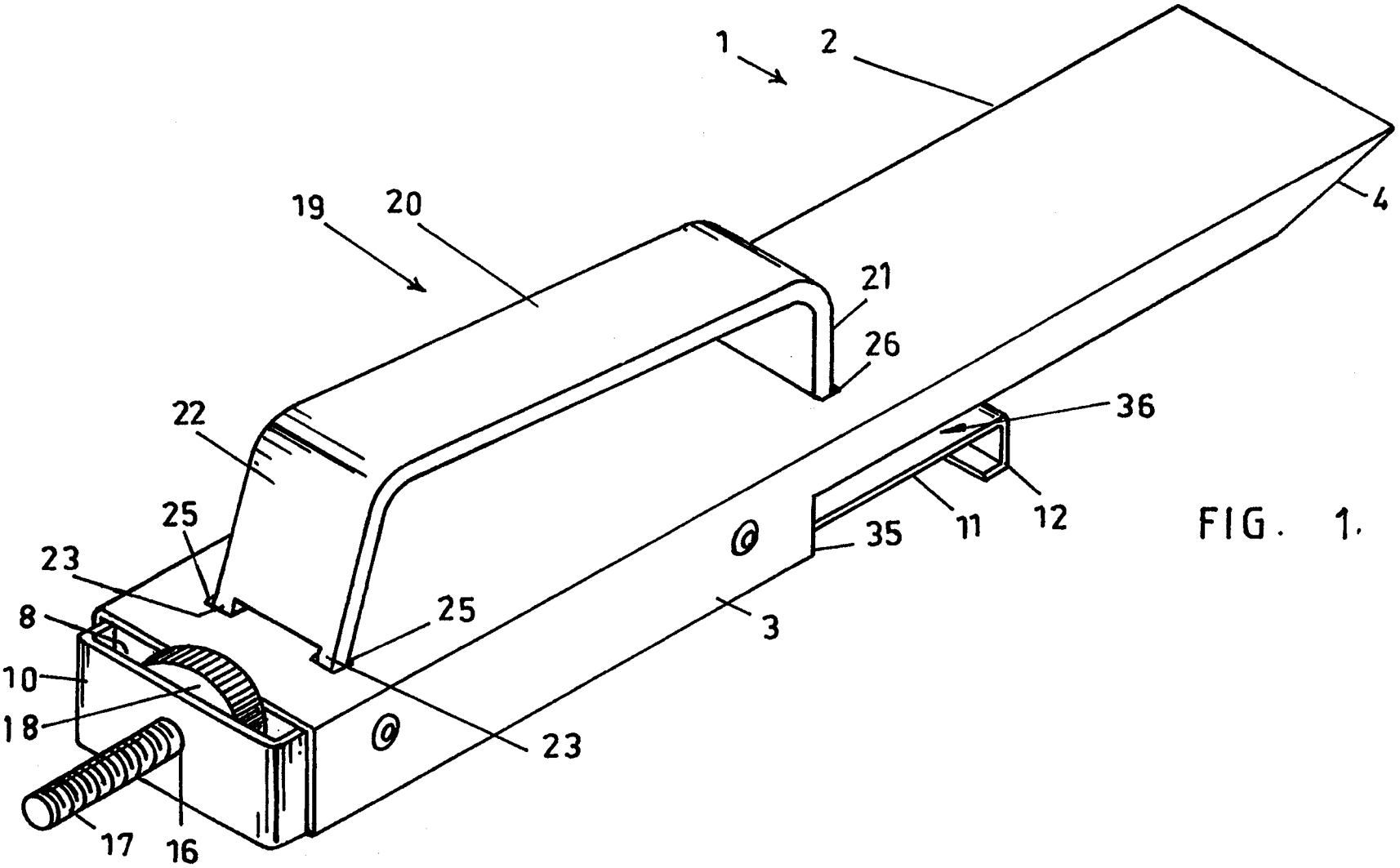
Figure 2:
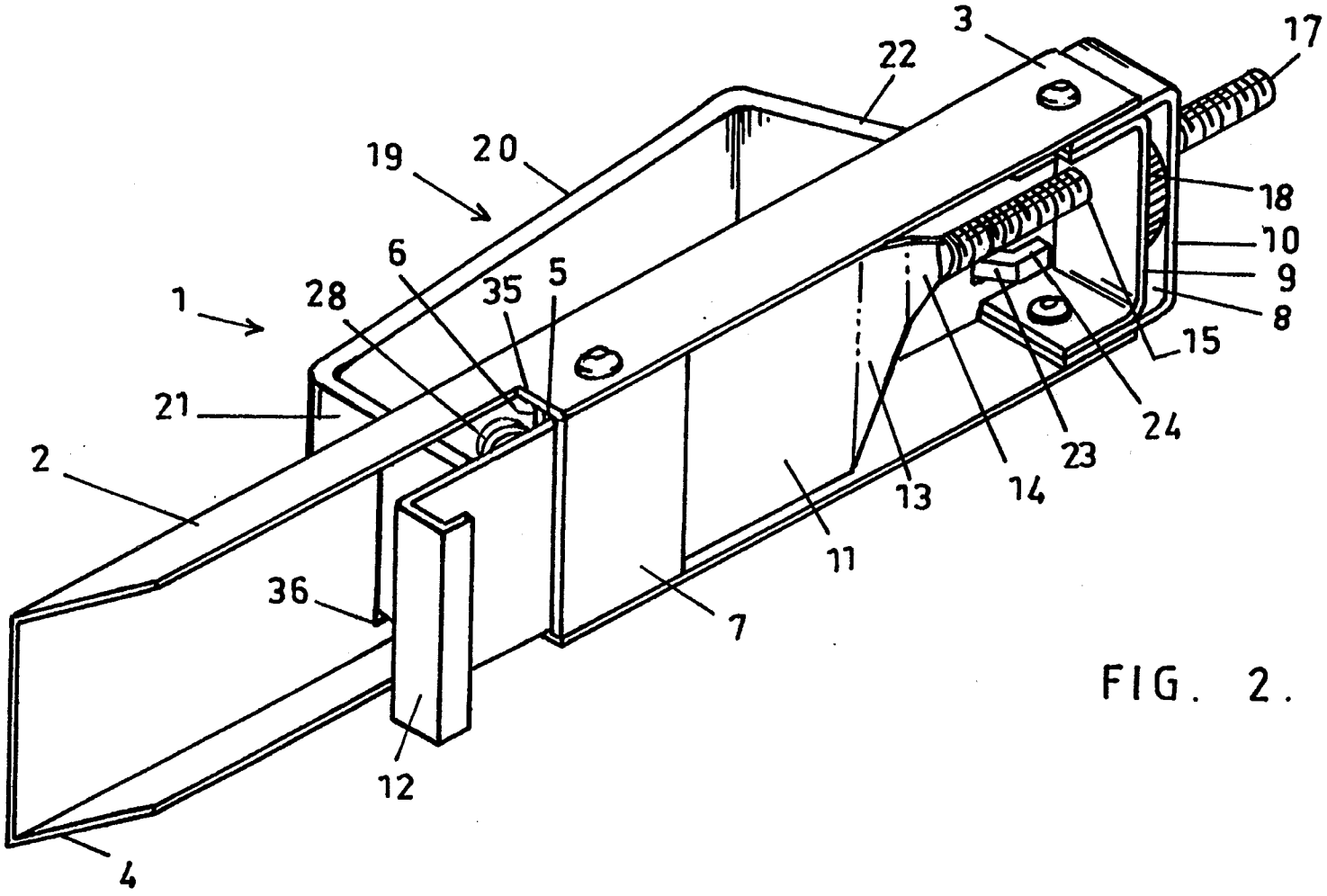

Two presently preferred embodiments of the invention will now be described with reference to the accompanying drawings in which:

FIG. 1 is a top perspective view of the tool of the invention,

FIG. 2 a perspective view of the underside of the tool

Figure 3:
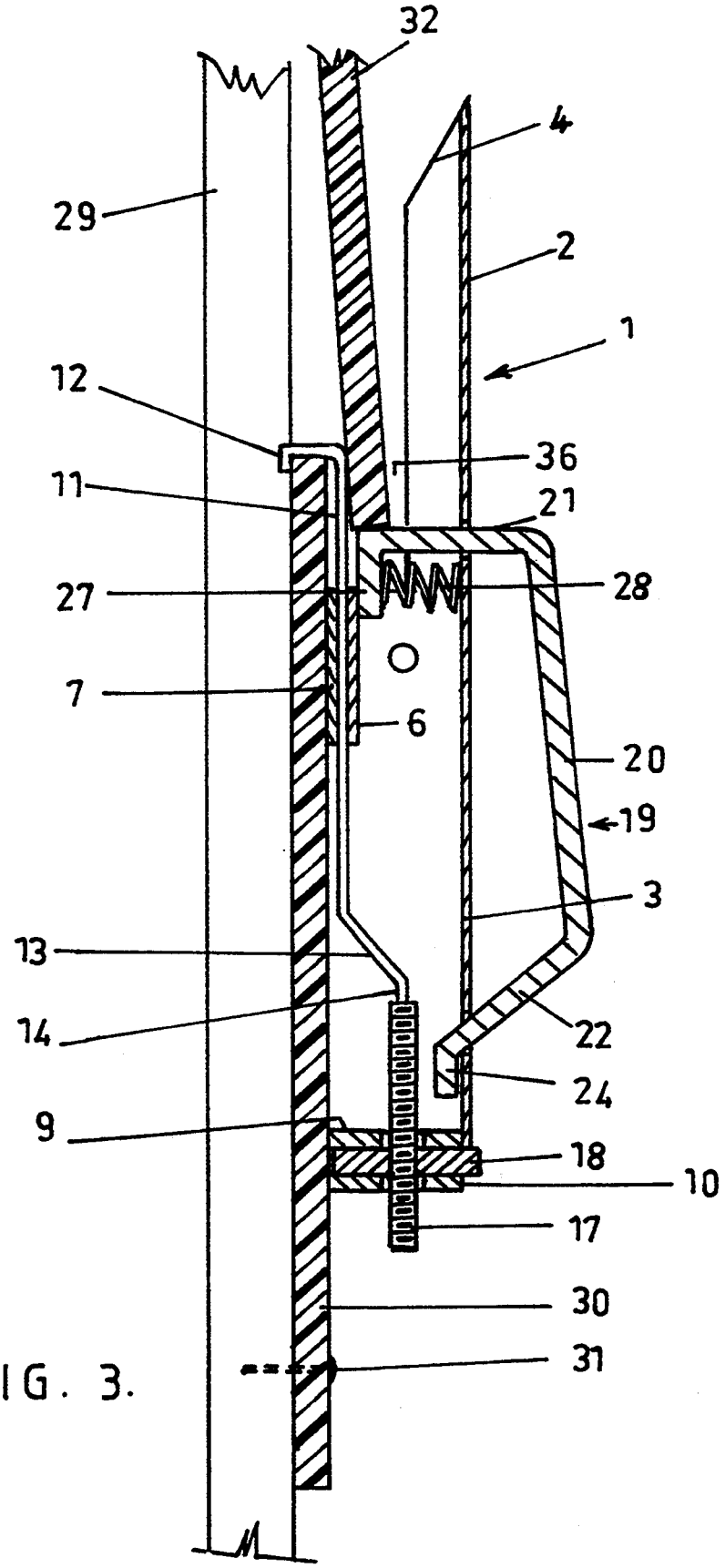
Figure 4:
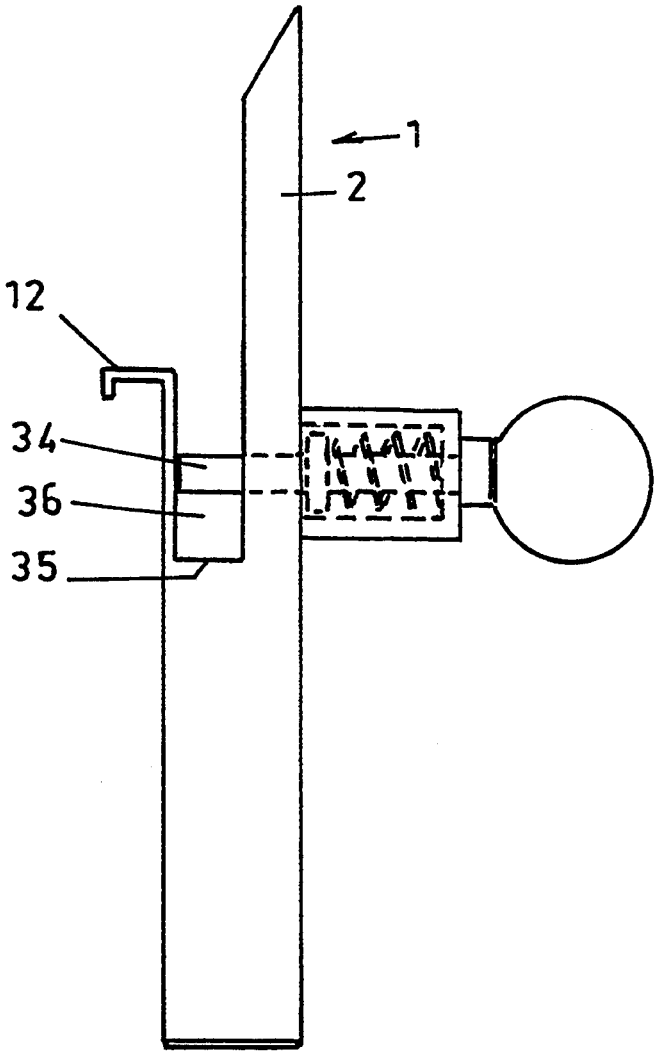

FIG. 3 is an end view of illustrating the relative relationship between the tool and a fixed plank and a plank supported by the tool and prior to fixing and FIG. 4 is a side elevation of a second embodiment of the invention.

As shown in FIGS. 1 and 2 the tool comprises an elongated body 1 of generally channel form having a first portion 2 with channel walls of a first height and a second portion 3 with channel walls of a greater height. The portion 2 has a tapered end 4 and the portion 3 has a slideway 5 between a pair of guides 6 and 7 and an adjusting nut housing slot 8 between members 9 and 10 at the end of the portion 3 remote from the portion 2.

There is a plank edge gripper 11 (best seen in FIGS. 2 and 3) slideably mounted in the slideway 5. The gripper 11 has a hooked front end 12 and a rear portion cranked at 13 to provide a tongue 14 aligned with holes 15 and 16 through the members 9 and 10. There is a threaded rod 17 connected at one end to the gripper tongue 14 and the rod 17 is in threaded engagement with an adjusting nut 18 in the slot 8. By rotating the nut 18 the gripper 11 can longitudinally moved relative to the body 1.

An arch form handle 19 is mounted on the body. The handle 19 has a central gripping portion 20 and a front leg 21 and a rear leg 22. At the free end of the leg 22 there are two spaced apart leg extensions 23 with bent end sections 24 and the leg extensions 23 pass through clearance holes 25 in the body portion 3 thereby to pivotally mount the rear end of the handle on the body 1. At the other end of the handle 19 the leg 21 extends through a slot 26. At the free end of the leg 21 there is a leg return portion 27 (see FIG. 3) which lies between the underside of the portion 3 and the guide 6 against which it bears under the influence of a compression spring 28. As the guide 6 is thin the gap between the free end of the leg 21 and the adjacent face of the gripper 11 is small and substantially less than the thickness of the planks to be supported on the leg 21 in the gap between the gripper 11 and the tool portion 2.

The use of the tool can be seen from FIG. 3 which shows a wall stud 29 and a plank 30 fixed by nails 31 to the stud 29 and a plank 32 supported by the hooked engagement of the tool with the plank 30. It will be seen that the hooked gripper end 12 is engaged with the top edge of the plank 30 and the plank 32 is supported on the handle leg 21. There would normally be two tools hooked onto the plank 30 between studs 29 to support the plank 32. The tools would be placed a short distance in from the ends of the plank 30, in the case of a 4.2 meter plank about 1 meter in from each end. In a plank fixing operation the tools would be adjusted for a desired overlap of the planks and the tools would be hooked onto the plank 30 and the plank 32 would be lowered onto the handle legs 21. The tapered end 4 of the tool portion 2 facilitates the entry of the plank 32 between the tool body portion 2 and the gripper 11. In this way a single workman can accurately position and support the plank 32 whilst temporary securement of the plank 32 by nails to the stud 29 is made.

If required the position of the gripper hooked end 12 relative to the tool body can be adjusted by rotation of the nut 18 to position the plank 32 relative to the plank 30. However, once a datum bottom plank has been fixed level to the stud there is seldom need for corrective adjustment of the gripper position relative to the tool body.

With the plank 32 supported on the tools plank fastening nails or screws 31 would be driven home in a central zone of the plank 32 spaced from the ends of the plank where the plank 32 is supported by the tools. In the tool removing procedure the handle leg 21 is withdrawn through the tool portion 2 against the bias of the spring 28 to provide a space between the leg return 27 and the gripper 11 sufficient to allow the plank 32 to pass. As the bottom 35 of the plank receiving slot 36 between the gripper and the body portion 2 is spaced further from the leg 21 than the distance needed to disengage the hook 12 from the plank 30 the tool can now be raised sufficiently to achieve disengagement and then the tool can be moved away from the plank 30 and then downwardly to remove the tool body portion 2 from behind the plank 32. This is made possible because the plank ends are not fixed and because of the natural flexibility of the plank 32.

It will be seen that tools of the invention when used as disclosed allows a single workman to readily and accurately position planks and to have them supported sufficiently to allow him to initiate the fixing of the supported plank. The economic advantages that arise out of the accuracy and speed of plank fixing using the tool of the invention are at once obvious.

The foregoing is the description of a preferred embodiment of the invention and it is to be understood that changes to the form of the components can be made without departing from the disclosed inventive concept. By way of example only, the compression spring 28 could be replaced by another form of spring. Further, the spring bias is desirable but not essential and a latch means of a suitable type could be used to releaseably retain the leg 21 in the slot obstructing position.

The form of the pivot connection between the handle and the body could be replaced by an alternative connection.

The member 21 need not be part of a hinged handle but may be replaced by a spring loaded plunger as indicated 34 in the non-adjustable basic form of the invention shown in FIG. 4. The adjustability of the gripper is desirable but it is to be understood that a tool without that feature as illustrated in FIG. 4 is still considered by the inventor to be an embodiment of the invention.

The nut and threaded rod adjustment for the gripper whilst simple and efficient could be replaced by an alternative arrangement without departing from the concept involved in the tool.

The fabricated metal construction of the body is not essential and the tool components could, for example, be moulded in plastics material.

I claim:

1. A tool for fixing a plank cladding, comprising:

a first elongated member having a first end and a second end;

guide means being positioned on said first elongated member intermediately between said first end and said second end;

a first plank support leg formed by a portion of said first elongated member located between said guide means and said first end of said first elongated member;

a second plank support leg;

a second elongated member mounted in said guide means with a portion of said second elongated member extending beyond said guide means for providing said second plank support leg, which is spaced from said first plank support leg with the space between maid first plank support leg and said second plank support leg providing a plank receiving slot;

a hook on said second plank support leg directed away from said first plank support leg;

adjustment means for connecting said second elongated member to said first elongated member so that the length of said second plank support leg is capable of being varied;

an elongated handle having a first end and a second end;

a pivot connection between a first end of said elongated handle and the first elongated member adjacent the second end of said first elongated member;

a plank retainer on said elongated handle adjacent the second end of said elongated handle and extending freely through an opening in said first plank support leg; and, resilient biassing means for urging said plank retainer into a position wherein it obstructs the plank receiving slot.

2. The tool according to claim 1, wherein said plank retainer includes a lug and said biassing means comprises a compression spring disposed between said lug and said first elongated member.

3. The tool according to claim 1, wherein said adjustment means comprises an elongated threaded member connected to said second elongated member and engaged in a nut mounted on said first elongated member so as to be rotatable, but substantially prevented from movement in the direction of said elongated threaded member.

4. The tool according to claim 3, wherein said first elongated member is of channel cross-section and walls of the channel forming said first plank support leg have a height less than a height of said walls of a remainder of said first elongated member, said guide means supports said second elongated member within said channel and said second elongated member has said hook at one end and is connected at its other end of said elongated threaded member.

* * * * *